310-13 SR
FIP8502 XR 4,072,101

United States Patent [19]
Garcia et al.

[11] 4,072,101
[45] Feb. 7, 1978

[54] LINEAR ACTUATOR PRINTER CARRIAGE

[75] Inventors: Joe La Garcia, Arvada, Colo.; Brandt Mead Griffing, Arcadia, Fla.; Paul Yu-Fei Hu, Boulder; Richard George Millington, Longmont, both of Colo.

[73] Assignee: International Business Machines Corporation, Armonk, N.Y.

[21] Appl. No.: 690,770

[22] Filed: May 27, 1976

[51] Int. Cl.[2] ..... B41J 9/04
[52] U.S. Cl. ..... 101/93.15; 197/1 R; 310/13; 310/27
[58] Field of Search ..... 101/93, 15–17, 101/426; 197/1 R, 16–20, 82, 49, 53–58; 178/27, 33 R; 310/12–18, 50, 27

[56] References Cited

U.S. PATENT DOCUMENTS

| | | | |
|---|---|---|---|
| 3,456,136 | 7/1969 | Pierro | 310/12 |
| 3,618,514 | 11/1971 | Nyman et al. | 101/93 |
| 3,659,124 | 4/1972 | Lathrop | 310/27 X |
| 3,696,204 | 10/1972 | Hallskog | 178/27 |
| 3,751,693 | 8/1973 | Gabor | 310/13 |
| 3,816,777 | 6/1974 | Metzger et al. | 310/13 |
| 3,840,762 | 10/1974 | Kasabian | 310/50 |
| 3,852,627 | 12/1974 | Davis | 310/13 |
| 3,882,988 | 5/1975 | Sloan et al. | 197/8 L X |
| 3,899,699 | 8/1975 | Griffing | 310/27 R X |
| 3,911,828 | 10/1975 | Schwenzler | 310/13 |

*Primary Examiner*—Edward M. Coven
*Attorney, Agent, or Firm*—Joscelyn G. Cockburn

[57] ABSTRACT

A linear actuator for positioning a print assembly parallel to a line on which characters are being printed is disclosed. The linear actuator includes a three-sided open structure magnetic circuit fabricated from rectangular pieces of slab magnets positioned about a central return path. The print assembly is seated on the open side of said linear actuator. Cooling for the actuator is achieved by pulling air in a direction perpendicular to the direction of motion of said print assembly.

3 Claims, 8 Drawing Figures

LINEAR ACTUATOR PRINTER CARRIAGE

BACKGROUND OF THE INVENTION

I. Field of the Invention

This invention relates to linear actuators and to the cooling of said actuators by forced air flow. More specifically the invention relates to a linear actuator which moves a print head in a direction parallel to a print line.

II. Prior Art

The use of linear actuators for positioning print heads is well known in the prior art. A typical linear actuator consists of a magnetic structure, an air gap, and a coil assembly positioned within the air gap. The print assembly is usually connected to the coil assembly and motion is achieved by the magnetic force acting on the coil within the air gap.

Generally, linear actuators may be classified into two groups; based on the manner in which the output is taken from said actuators. In one type of linear actuator the output is taken from a shaft which runs parallel with the horizontal or longest dimension of said actuator. In another type of linear actuator the output is taken from a carriage positioned on the top or open surface of the actuator.

The present invention is more related to the type of actuators where the output is taken from the top. Although the prior art actuators of this type function adequately for their intended purpose, they are plagued by several problems which the present invention will alleviate.

One of the problems which plague the prior art linear actuators is the inefficiency of the linear actuators due to the positioning of the coil in a relatively weak magnetic field. Generally, due to physical arrangement of the prior art linear actuators, only one piece of permanent magnet together with a magnetic loop or return path defines the magnetic circuit. As a result, the number of magnetic lines which are cut by the positioning coil is rather limited and, therefore, the force exerted on the coil, which in turn positions the print head, is relatively low.

One would imagine that the force of these prior art linear actuators would improve by increasing the current density to the positioning coil. However, due to the construction of the prior art coils, the optimum amount of current which can be supplied to the coils is significantly low due to heat generation. Generally, prior art coils are self-supporting. This means the coils are wound from wire strands without any supporting structure and are held together by adhesive substance. With this construction, if current density to the coil exceeds a predetermined value, then the adhesive substance will soften from heat generated by the high current density. Whenever weakening occurs the coil structure, which positions the print assembly, weakens and wobbles as it moves to and fro in positioning the print assembly. This defect further reduces the overall performance of the prior art linear actuators.

Another problem with the prior art devices is that they are relatively expensive. The expense partially stems from the fact that the permanent magnet and other magnetic materials are circular shape. The manufacturing cost of irregular shaped material is significantly more expensive than planar shaped material. As such, the increased machining costs help to increase the overall cost of the prior art linear actuators. By using irregular shaped magnets and magnetic material to form the magnetic circuit of the prior art actuators, it is very difficult to define or set the air gap within which the positioning coil must travel. Due to the importance of the air gap setting to the overall performance of the actuator, the pieces which form the magnetic circuit must be machined with high precision tolerances. This also tends to increase the cost of the prior art linear actuator.

There has been an attempt made to correct some of the aforementioned prior art problems by fabricating a linear actuator using rectangular magnetic structure. Although this structure shows improvement over the prior art devices which are manufactured from irregular-shaped magnetic structure, it also has several problems. Its most outstanding problem is its inefficiency in performance. This stems from the fact that only one surface of the magnet creates flux line for linking the positioning coil. Another problem is that the coil form is rather complicated.

Still another problem which faces the prior art actuators is cooling. Most prior art actuators are cooled by forced air. However, the air is generally forced in a direction parallel to the direction of motion of the coil. However, the air resistance which the coil experienced in its to and fro motion tends to reduce its speed in one direction and increase its speed in the other direction. Also, the prior art coils are not uniformly cooled, which also tends to reduce the efficiency of the linear actuator.

A more detailed discussion of the aforementioned linear actuators is disclosed and discussed in U.S. Pat. No. 3,696,204 and 3,618,514.

SUMMARY OF THE INVENTION

The present invention overcomes the drawbacks found in the prior art by means of a linear actuator with unique physical and cooling characteristics.

More specifically, the linear actuator includes an open-sided rectangular magnetic structure with a moving coil positioned within the air gap of said magnetic structure. The magnetic structure includes a centrally located rectangular return path. Three pieces of rectangular-shaped slab magnets are operably connected to rectangular pieces of soft iron. This combination of magnets and soft iron are positioned in space relationship about the central return path. The magnetic lines of flux which are generated by the magnets are perpendicular to the central return path. A coil structure comprising of a thin aluminum shell upon which a coil is wound is positioned within the air gap. The force, which is exerted on the coil due to the perpendicular flux lines, and current moves the coil forward and backward within the air gap.

In another feature of the invention, a carriage assembly for positioning a print head is operably attached to the positioning coil.

In still another feature of the invention, a positioning means comprising of a linear tachometer strip, a light source, and a light receiving means is operably connected to the actuator housing.

Still another feature of the invention includes the positioning of air ducts, one on each of the longitudinal sides of said actuator. By applying vacuum to said air ducts, forced air for cooling is pulled in a direction perpendicular to the direction of motion of said coil. To restrict the air flow within the actuator, two spacers are positioned, one on each side of the magnet which is positioned at the bottom of the actuator.

The foregoing and other objects, features and advantages of the invention will be apparent from the following more particular description of the preferred embodiment of the invention, as illustrated in the accompanying drawings.

DETAILED DESCRIPTION OF THE PREFERRED EMBODIMENT

Figure 1:
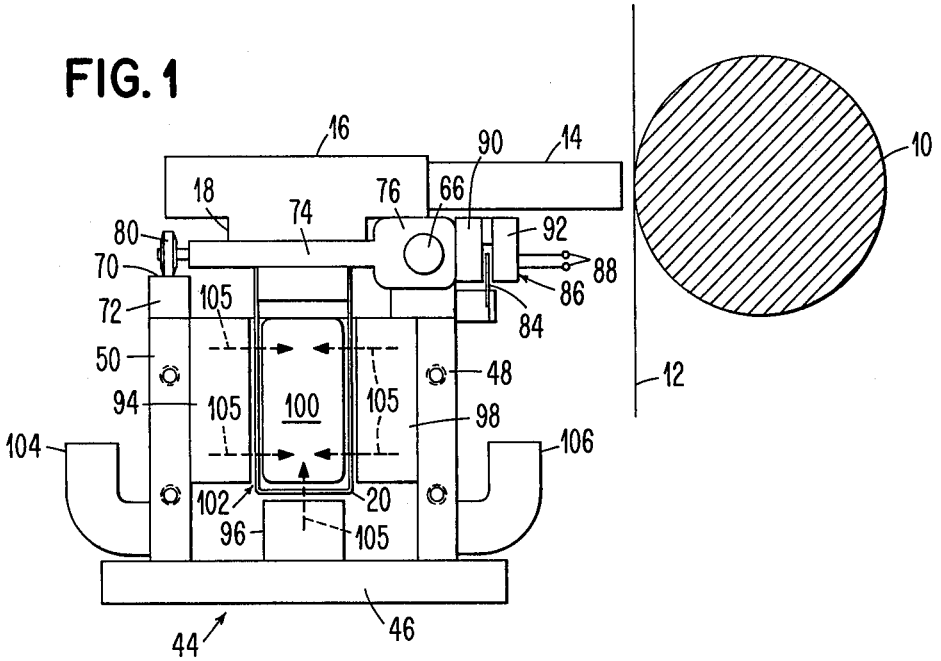
FIG. 1 shows a front cross-sectional view of the linear actuator positioning a print head relative to a print line.

For purposes of description, similar parts will be described with like numbers in the drawings.

The linear actuator described herein can operate in any environment where a member has to be positioned along a predetermined path or, in the alternative, can be employed for positioning a print head. Since the invention adapts itself very well to the positioning of print heads, it is described within this environment.

FIG. 1 illustrates a conventional print means having a print drum 10 with rows of print type on its periphery and which is rotated by a driving means (not shown). Paper 12 is advanced (by conventional means) to a position adjacent print drum 10 and across a line, hereinafter called the print line, which is parallel to the lengthwise dimension of print drum 10.

A hammer module 14 is attached to print head means 16 and the assembly (i.e., print head 16 and hammer module 14) is positioned by carriage assembly 18 in a direction parallel to the print line.

The apparatus for moving the assembly along a line parallel to the print line is illustrated in FIGS. 2, 3, 4, and 5. Coil bobbin means 20 (see FIGS. 1, 3, 4, and 5) is attached to carriage assembly 18. As will be explained subsequently, coil bobbin means 20 is positioned within an air gap formed by the magnetic circuit of the linear actuator. By cutting the magnetic lines of flux which emanate from the magnetic structure, motion is imparted to the print head means via carriage assembly 18.

Figure 5:
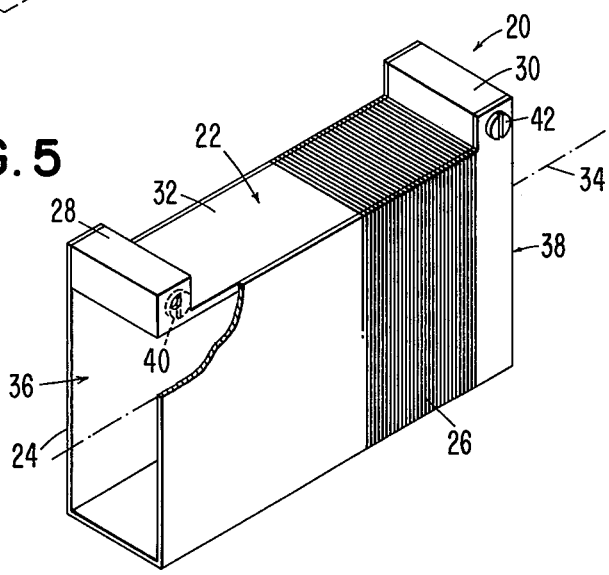
FIG. 5 depicts coil and bobbin.
Figure 6:
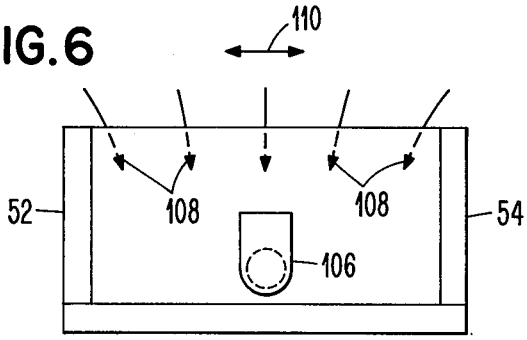
FIG. 6 depicts the actuator housing, showing the traverse direction of air flow.
Figure 7:
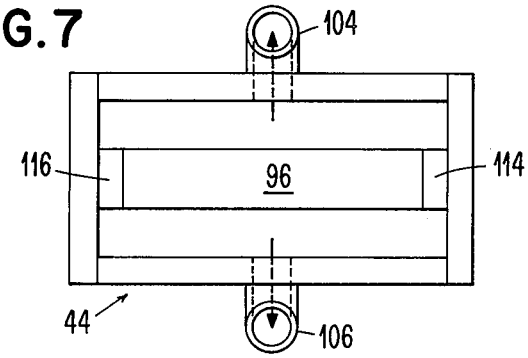
FIG. 7 depicts a top view of the actuator showing the spacer means which restrict direction of air flow within the actuator.

Referring now to FIG. 5 coil bobbin means 20 is shown. Coil bobbin means 20 comprises of a non-conducting portion 22, a substantially three-sided rectangular shell 24, and coil 26. Non-conducting portion 22 is fabricated from a non-conducting material, e.g., plastic or wood depending on structural requirements. It is rectangular in shape with projections 28 and 30 extending above upper surface 32. As will be explained subsequently, fastening means (not shown) attaches carriage assembly 18 to projections 28 and 30 of the coil bobbin means 20. Rectangular shell 24 is fabricated from relatively thin aluminum sheet. In the preferred embodiment of this invention, the aluminum sheet has thickness in the order of millinches. The aluminum sheet is then fashioned into a three-sided structure with an open side running in a direction parallel to horizontal axis 34. Rectangular shell 24 is also fabricated with open ends 36 and 38 extending perpendicular to horizontal axis 34. Rectangular sheel 24 is then connected to non-conducting portion 22 via screw means 40 and 42. Of course, other conventional means may be used for attaching rectangular shell 24 onto non-conducting portion 22. Coil 26 is then wound onto aluminum shell 24 and non-conducting portion 22. Due to the thinness of the rectangular shell and the non-conducting material position in the coil supporting structure eddy current is significantly reduced which in turn improves the efficiency of coil bobbin means 20. It should also be noted that the aforementioned coil structure is rigid and is better able to support the carriage assembly and its associated print head and hammer module.

Figure 3:
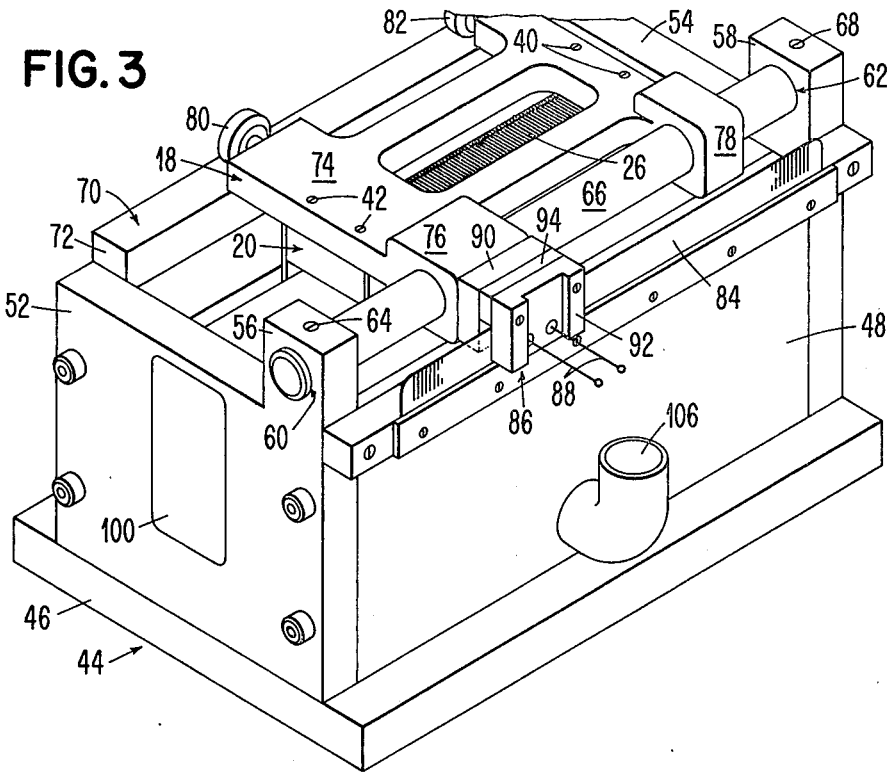
FIG. 3 shows a pictorial view of the actuator with coil carriage assembly and cooling means.

Referring now to FIGS. 3 and 4, a pictorial view of the linear actuator with carriage assembly 18 is shown. Carriage assembly 18 is attached to coil bobbin means 20 via fastening means 40 and 42. Coil 26 of coil bobbin means 20 is then positioned within the air gap defined by the magnetic structure of said linear actuator. The linear actuator includes support frame 44. Support frame 44 is fabricated from magnetic material which has low magnetic reluctance and resistivity. For example, soft iron is an acceptable material. In addition to its support function, support frame 44 forms the return path to complete the magnetic circuit of the linear actuator. Support means 44 also serves as the guide means for carriage assembly 18.

Referring now to FIGS. 1, 3, 4A, and 4B support means 44 includes bottom return plate 46, side return plates 48 and 50, and end return plates 52 and 54. Side return plates 48 and 50 are attached to bottom return plate 46. Also end return plates 52 and 54 are attached onto side return plates 48 and 50 to form a substantially rectangular support frame for the magnetic structure. In the preferred embodiment of this invention the side and end return plates are pinned onto the bottom return plate. Of course, other fastening means may be used without departing from the scope of the invention. In order to accommodate carriage assembly 18 return plates 52 and 54 are fabricated with projections 56 and 58 respectively. Two circular holes, 60 and 62, are bored within the projections and shaft 66 is positioned within said holes. In order to hold shaft 66 firmly into holes 60 and 62, fastening means 68 and 64 are operably attached thereto. By torquing fastening means 64 and 68 the motion of shaft 66 is arrested. Likewise, rectangular guide rail 72 having flat upper surface 70 is connected to side return plate 50 (see FIG. 1).

Carriage assembly 18 includes load platform 74. Load platform 74 is attached to bushing means 76 and 78. The bushing means are slidably mounted to shaft 66. Also, load platform 74 is connected to ball bearing means 80 and 82. In order to position the print head means (16) with its hammer module (14), magnetic force is applied to coil bobbin means 20 via the magnetic circuit of the linear actuator. Simultaneously, current is applied to the coil bobbin means. A force in turn is transmitted to load platform 74; as coil bobbin means 20 move to and fro via the sliding motion of bushing means 76 and 78 on shaft 66 and the rolling motion of ball bearing means 80 and 82 on flat surface 70 of rectangular rail 72.

In order to locate the position of carriage assembly 18, a positioning means, which associates with carriage assembly 18 is operably connected to support frame 44.

Figure 2:
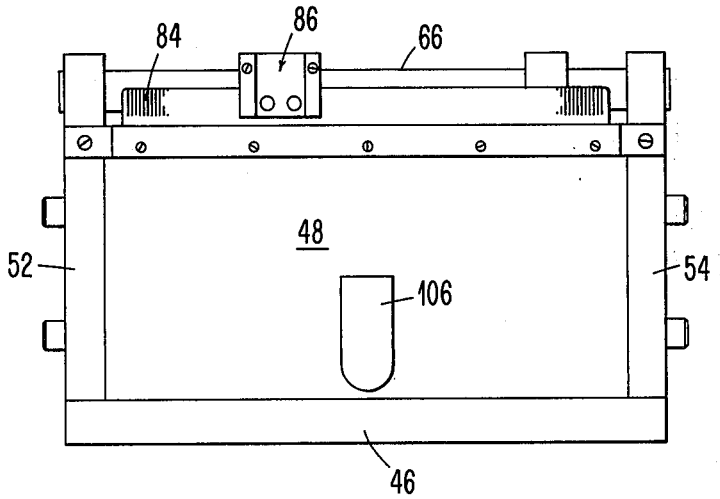
FIG. 2 depicts a side view of the actuator showing magnetic return paths and tachometer assembly.

The carriage assembly includes a conventional linear tachometer strip 84 (FIGS. 2, 3, and 4). Tachometer strip 84 is fabricated from transparent material upon which a plurality of dark light lines are positioned. The distance between two dark lines are representative of some incremental distance. The tachometer block assembly 86 is attached to bushing means 76 and positioned in space relationship with tach strip 84. In order to obtain output signal from tachometer block assembly 86, terminal means 88 (FIG. 3) is connected thereto. Tachometer block assembly 86 includes a light source (not shown) which is attached to block 90. The light source illuminates the optical tach strip. Light receiving means (not shown) is attached to second block means 92. The second block means with its light receiving means is positioned via spacer means 94 in optical alignment with the light source position on block 90. In the preferred embodiment of this invention a light emitting diode (LED) was used as the light source while a light sensitive transistor was used as the light receiving means.

In operation, as carriage assembly 18 moves within its defined path, tachometer block assembly 86 is positioned about linear tach strip 84. The output signals from tachometer block 86 are used to determine both position and the direction of motion of carriage assembly 18. As will be explained subsequently in order to cool the actuator, a rectangular hole is fabricated on the upper surface of load platform 74. Air is pulled from the ambient surroundings, through the hole, to cool coil 26.

Figure 4A:
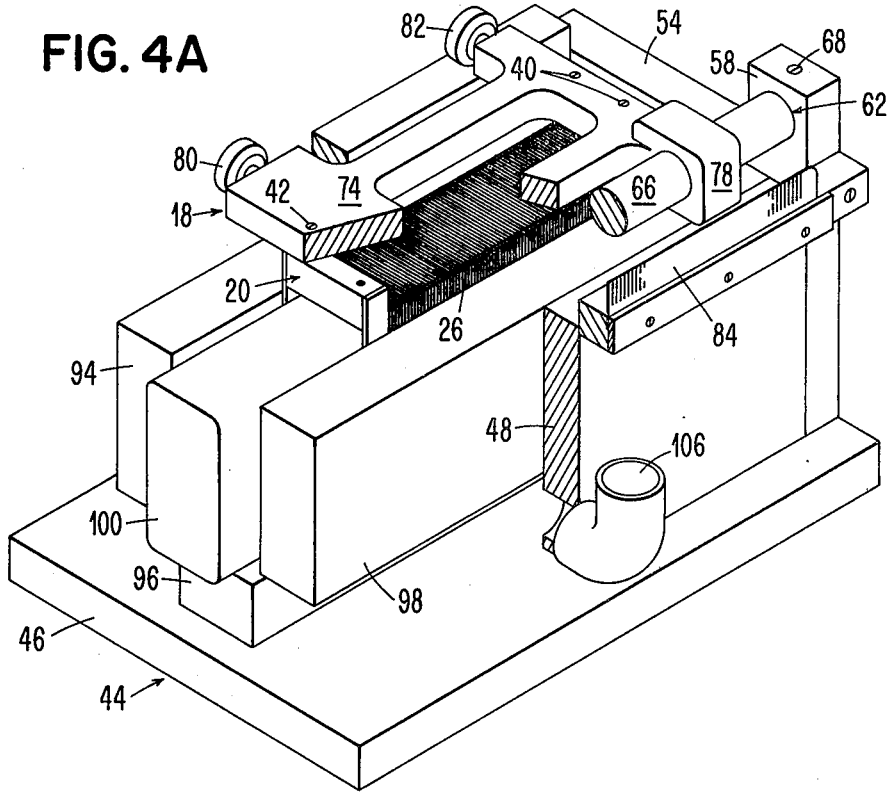
FIGS. 4A and 4B show a breakaway view of the actuator with flux lines.
Figure 4B:
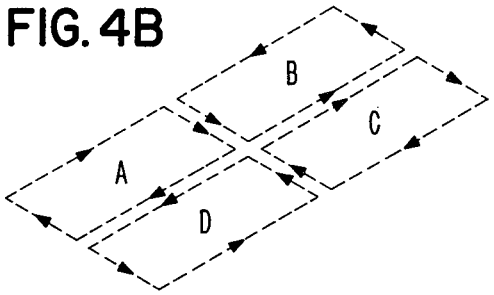

Referring now to FIG. 3, FIG. 4A, and FIG. 4B, the magnetic structure which creates magnetic lines of flux which interact with positioning coil assembly 20 is shown. The magnetic structure comprises of permanent rectangular slab magnets 94, 96, and 98. Each magnetic member is manufactured from hard permanent magnets, e.g., alnico 8 or ceramic magnets. Each of the magnets are rectangular in shape, that is slab magnets and is attached by fastening means to the return path or frame of said linear actuator. For example, in the preferred embodiment of this invention, permanent magnet 94 is attached to side return plate 50 with epoxy (FIG. 1). Likewise, permanent magnet 96 is attached by epoxy to bottom return path 46, while permanent magnet 98 is attached to side return path 48 by epoxy. Magnetic central return path 100 is positioned centrally so that the permanent magnet is positioned in space relationship with three of the sides of said return path, to define air gap 102 (FIG. 1). The longest dimension, of each rectangular slab of magnet, runs parallel to the longest dimension of the central return path 100. In the preferred embodiment of this invention, the central return path is fabricated from material analogous to the aforementioned materials from which the return path is fabricated. Permanent magnets 94, 96, and 98 are uni-pole magnets. By positioning the magnets to form a rectangular structure about the central return path, flux lines 105 (FIG. 1) which are substantially perpendicular to the return path, are emanated from the permanent magnets to cross air gap 102. As was mentioned earlier, coil bobbin 20 is positioned within the air gap defined by the permanent magnets and the central return path. As the coil bobbin assembly cut the flux lines, magnetic force is exerted on three sides of the coil and as a result, rapid to and fro motion of the print assembly parallel to a print line is achieved.

FIG. 4B depicts a plurality of closed flux paths A, B, C, and D which link the sides of coil assembly 20. The flux linkage which is generated by magnet 96 is not shown, but its implementation will be obvious to one skilled in the art. By arranging the permanent magnets so that a plurality of flux lines are created, each of which links the winding of coil bobbin assembly 20, the actuator is able to perform more efficiently than was heretofore been possible.

Referring now to FIGS. 1, 3, 6, and 7, a traverse cooling means is depicted for coil assembly 20. Support frame 44 together with permanent magnets 94, 96, and 98 respectively, define a low pressure chamber within which coil assembly 20 has to and fro movement. The pressure in the chamber is lower than the ambient pressure. In order to create the low pressure in the chamber, air ducts 104 and 106 (FIG. 1) are positioned, one on each side member of the linear actuator. For example, in FIG. 6 a side view of the actuator is shown with air duct 106, by applying a conventional vacuum pump (not shown) to the air ducts, air is pulled into the chamber in the traverse direction shown by arrows 108 (FIG. 6), which cools the coil and is then exhausted through vacuum duct 104 and 106. Alternately, air can be pumped into the vacuum ducts and is allowed to escape through the open top of the linear actuator. When vacuum source is applied to air ducts 104 and 106, the vacuum created by the air moving from the high pressure source to the low pressure source together with the weight of the carriage preloads the carriage assembly to remain stable and therefore obviate the need for complex preloading mechanism. As can be seen more clearly in FIG. 6, the direction of air flow 108 is perpendicular (i.e., traverse) to the direction of coil motion 110. Due to the fact that the direction of air flow is always perpendicular to the direction of coil motion, the resistant force which the air exerts against the coil assembly is minimal and therefore improves the overall efficiency of the actuator. In order to restrict air flow in the internal chamber of the actuator to be adjacent to the coil, spacer means 116 and 114 (FIG. 7) are fitted so as to be in contact with the ends of magnet 96 and in contact with end return plates 52 and 54. The spacer means enable the air to always flow in the direction adjacent to the coil, and therefore, effectuate a more efficient cooling scheme. Stated another way the spacers prevent cooling air which is pulled into the actuator housing from flowing along the end section of the actuator and escaping through the vacuum duct 104 and 106.

While the invention has been particularly shown and described with reference to the preferred embodiment thereof, it will be understood by those skilled in the art that various changes in form and details may be made therein without departing from the spirit and scope of the invention.

What is claimed is:

1. Linear actuator comprising in combination:

a single rectangular magnetic flux return path; said magnetic flux return path being stationary and centrally located;

a magnetic structure being positioned in spaced relation with only three sides of said return path; said magnetic structure having only three pieces of rectangular slab magnetts being arranged so that each piece of the slab magnets faces one of the sides of said magnetic flux return path to supply flux lines perpendicular to said return path;

an air gap operably positioned between the magnetic flux return path and the slab magnets;

a coil bobbin means operably positioned to move within said air gap; and means operable for supplying electrical energy to said coil bobbin.

2. The device as claimed in claim 1 further including a carriage assembly operably connected to the coil bobbin means.

3. The device as claimed in claim 2 further including print means operably connected to said carriage assembly.

* * * * *